US005408712A

United States Patent [19]

Brun

[11] Patent Number: 5,408,712

[45] Date of Patent: Apr. 25, 1995

[54] QUILT FILLED WITH DIFFERENT MATERIALS

[75] Inventor: Pierre Brun, L'Isle sur Sorgue, France

[73] Assignee: Etablissements Brun De Vian Tiran, L'Isle sur Sorgue, France

[21] Appl. No.: 917,984

[22] Filed: Jul. 24, 1992

[51] Int. Cl.[6] ..... A47G 9/00

[52] U.S. Cl. ..... 5/502; 5/486

[58] Field of Search ..... 5/482, 485, 486, 493, 5/502

[56] References Cited

U.S. PATENT DOCUMENTS

| | | | |
|---|---|---|---|
| 1,221,890 | 4/1917 | Millar | 5/502 |
| 1,425,952 | 8/1922 | Fidler | 5/485 |
| 2,799,870 | 7/1957 | Sullivan | 5/502 |
| 2,834,033 | 5/1958 | O'Brien | 5/502 |
| 4,274,169 | 6/1981 | Standiford | 5/502 |

FOREIGN PATENT DOCUMENTS

| | | | |
|---|---|---|---|
| 755077 | 9/1933 | France | 5/502 |
| 795376 | 9/1935 | France | 5/502 |
| 796308 | 10/1935 | France | 5/502 |
| 2599610 | 12/1987 | France | 5/502 |
| 158330 | 4/1903 | Germany | 5/502 |

*Primary Examiner*—Flemming Saether
*Attorney, Agent, or Firm*—Bacon & Thomas

[57] ABSTRACT

The invention relates to the production of quilts for beds and similar goods.

The quilt comprises a central zone (18) designed to cover the top of the bed and a peripheral zone (20). The central zone is filled with at least two layers of different filling materials. The peripheral zone is filled with with at least one layer of one filling material.

3 Claims, 1 Drawing Sheet

QUILT FILLED WITH DIFFERENT MATERIALS

The present invention relates to quilts or similar goods designed to cover the top of a bed and to drop down the sides and foot of said bed in order to ensure the comfort of the sleeper.

As conventionally known, quilts are produced from a bag receiving a filling material. Mainly, said material is constituted by acrylic or polyester fibers, wool or down. The assembly is then put together and stitched, and placed in a quilt cover.

In the most conventionally known quilts, the filling material is the same, whether it is used in pure or mixed form, throughout the whole quilt. Therefore a quilt, measuring for example 2.20 m×2.40 m, requires a relatively large quantity of filling material, which can make the quilt very expensive if such material is itself expensive, such as down for example.

To overcome this drawback, it has already been proposed to produce the part of the quilt corresponding to the top of the bed with a first material and the peripheral parts with a second filling material. Such a step makes it possible to restrict the quantity of expensive filling material to the part of the quilt which is effectively useful and to fill the peripheral parts with less expensive filling materials.

An object of the present invention is to provide a quilt which is further improved over the abovementioned prior art quilts.

According to the invention, the quilt which comprises a central part intended to cover the top of the bed and a peripheral part intended to drop down the sides and the foot of the bed, is characterized in that the central part is filled with at least a first layer of a first padding material and a second layer of padding material, different from the first, and in that said peripheral part is filled with at least one layer of padding material.

It is obviously possible, with this method, to obtain all the possible combinations of the different materials, as a function of their specific quality, their cost and the comfort that they provide. Indeed, the sleeper's comfort can be analyzed according to three parameters:

- the thermal comfort: the quilt must isolate sufficiently the sleeper's body from the outside atmosphere so that the temperature of the micro-climate created under the quilt reaches a sufficient level;
- the physiological comfort: if the quilt meets the first requirement, it must not however stifle the micro-climate. Indeed, the steam which is continuously released by the body increases the moisture which is present under the quilt. It is therefore important for said quilt to be able to absorb the excess moisture while retaining the warmth; the created heat must be healthy to obtain a total thermi-physiological comfort;
- finally, a textile comfort: this comfort consists in the lightweight, the softness, the pleasant feel, the snugness which result from the choice of the materials used for making the quilt.

Another problem which the present invention has been able to solve is that of choosing the fabric constituting the quilt cover. Indeed, with certain filling materials, notably, it is necessary to use fabrics which have special properties and therefore which are relatively expensive. It is obvious that if two layers of materials are used in the central part of the quilt, and if one of these layers does not present such drawbacks, it will be possible to use, at least partly, a less expensive fabric.

Other characteristics and advantages of the present invention will be more readily understood on reading the following description of several embodiments of the invention given by way of example and non-restrictively. The description is given with reference to the accompanying drawings in which.

As already explained briefly, the principle of the invention consists in providing in the central part of the quilt corresponding to the top of the bed, a double filling layer of two different materials, and in the peripheral part of the quilt, a single filling layer of one of the two materials used in the central part.

Figure 1:
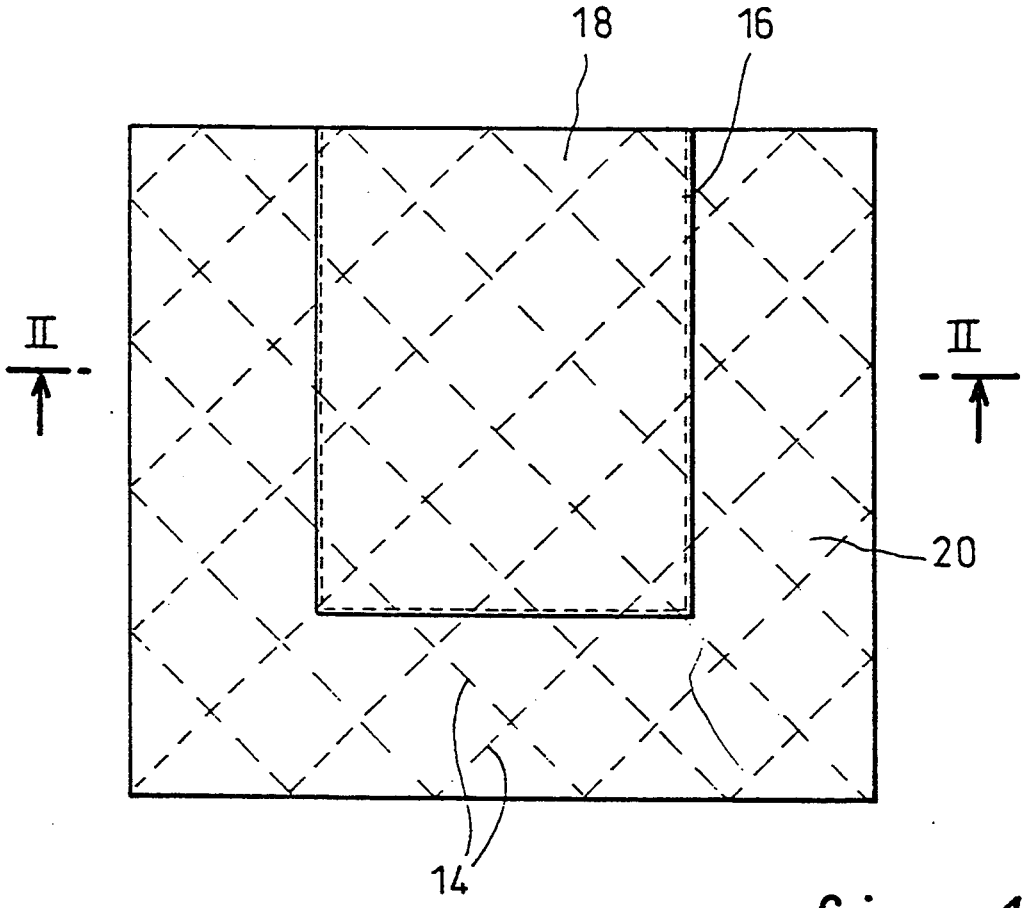
FIG. 1 is a plan view of a quilt according to the invention.
Figure 2:
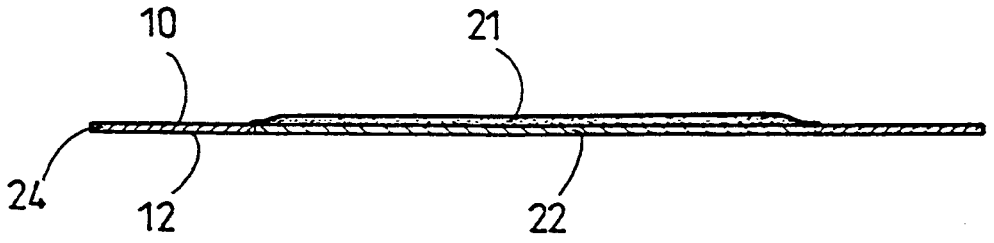
FIG. 2 is a cross-sectional view taken along line II—II of FIG. 1.

As illustrated in FIGS. 1 and 2, the quilt is constituted by two pieces of fabric 10 and 12 which constitute a bag inside which is placed the filling material. Once the filling material is in position, the two pieces of fabric 10 and 12 are stitched together so as to ensure a good distribution of the filling material when the quilt is used. The stitching lines made after the positioning of the filling material, as well as a stitching zone 16 separating the central zone of the quilt 18 from its peripheral zone 20, are symbolized in broken lines 14. The central zone 18 of the quilt is designed to cover the top of the bed whereas the peripheral zone 20 is designed to drop down the sides and the foot of the bed.

In FIG. 2, the upper filling layer in the central zone 18 is referenced 21, the lower filling layer in that same central zone is referenced 22 and the filling layer in the peripheral zone is referenced 20.

In a first embodiment, the lower filling layer 22 and the peripheral filling layer 24 are in wool. The upper filling layer of the central zone is in camel hair, cashmere, silk, cashegora, Merino wool, alpaca, llama, yak, synthetic fibers and cotton. A high adiathermal (thermal insulating) power is thus obtained, in the central part of the quilt, namely in that part which rests over the sleeper's body, which adiathermal (thermal insulating) power is increased by the addition of fine fibers while the lightness of the peripheral zone is preserved, the whole assembly remaining lightweight.

In a second embodiment, the lower layer 22 of the central zone is produced in cotton while the upper layer 21 of the central zone and the peripheral layer 24 are in wool. With the obtained quilt, the physiological comfort in summer, and in a humid climate, is increased due to the presence, in the central zone, of cotton, which is very hydrophilous and faces directly towards the sleeper's body.

In a third embodiment, the lower filling layer 22 of the central zone and the peripheral filling layer 24 are in wool. The upper layer 21 of the central zone is in down or half in down, or three-quarters in down and in small feathers. This particular disposition offers an added advantage. Indeed, the down requires the use as fabric forming the bag of the quilt, of down-proof percale to prevent the down from slipping through the cover. The wool, on the contrary, can easily be contained in a percale that is less tight or simply in a knitted material. It is therefore clear that, according to the embodiment just described, the lower piece of fabric 12 can be in porous percale or in knitted material, as only the top piece of fabric 10 needs to be in special down-proof percale.

With this disposition, a saving is made on the fabric used for producing the lower part of the bag 12 of the quilt, and for the same adiathermal power, a saving is made on the down, not only on the periphery of the quilt, but also in the central zone 18. Moreover, the physiological comfort is improved thanks to the use as the piece of fabric 12 facing towards the sleeper's body, of a more breathable material.

Other suitable materials are synthetic fibers, such as polyester or polyacrylics, or feathers.

Obviously, every filling layer 21, 22, 24 could be constituted by a mixture of filling materials. In other words, by filling material is meant, not only single materials but also mixtures of materials, each mixture being homogeneous.

In the foregoing description, the material filling the peripheral part is identical to that used'for constituting one of the filling layers 21 or 22 of the central part. But, it would not be outside the scope of the invention to fill the peripheral part with a third material. For example, an inexpensive synthetic fiber could be used for the layer 24. Similarly, the central part 18 could comprise three superposed filling layers or an even greater number of layers. For example, the two outermost layers would be relatively thin and in wool while the intermediate layer would be in down. This kind of solution makes it possible to use an ordinary percale or similar fabric for the pieces 10 and 12 while authorizing the presence of a layer of down.

It is claimed:

1. A quilt formed by a central part designed to cover the top of a bed and a peripheral part designed to drop over the sides and the foot of the bed, comprising:

upper and lower pieces of fabric;

filling material placed between said upper and lower pieces of fabric; and stitching means for maintaining in position said filling material between said pieces of fabric and for permanently attaching together said two pieces of fabric and said filling material, wherein said filling material comprises:

a first lower layer, comprised of a material which is different from down material and which is down-proof, disposed in said central part;

a second upper layer comprised of down material disposed in said central part; and a third layer comprised of a material different from down material disposed in said peripheral part.

2. A quilt according to claim 1 wherein said first layer and said third layer consist essentially of the same material.

3. A quilt according to claim 2, wherein said first lower layer and said third layer consist essentially of wool.

* * * * *